US010789910B2

(12) United States Patent
Aurongzeb et al.

(10) Patent No.: US 10,789,910 B2
(45) Date of Patent: Sep. 29, 2020

(54) INFORMATION HANDLING SYSTEM WITH DYNAMIC PRIVACY MODE DISPLAY

(71) Applicant: DELL PRODUCTS, LP, Round Rock, TX (US)

(72) Inventors: Deeder M. Aurongzeb, Austin, TX (US); Mohammed K. Hijazi, Austin, TX (US); Stefan Peana, Austin, TX (US)

(73) Assignee: Dell Products, L.P., Round Rock, TX (US)

( * ) Notice: Subject to any disclaimer, the term of this patent is extended or adjusted under 35 U.S.C. 154(b) by 134 days.

(21) Appl. No.: 15/215,164

(22) Filed: Jul. 20, 2016

(65) Prior Publication Data

US 2018/0025702 A1 Jan. 25, 2018

(51) Int. Cl.
*G09G 5/10* (2006.01)
*G09G 3/34* (2006.01)

(52) U.S. Cl.
CPC ..... *G09G 5/10* (2013.01); *G09G 3/3406* (2013.01); *G09G 3/3426* (2013.01); *G09G 2320/0626* (2013.01); *G09G 2330/021* (2013.01); *G09G 2354/00* (2013.01); *G09G 2358/00* (2013.01); *G09G 2370/16* (2013.01); *G09G 2380/02* (2013.01)

(58) Field of Classification Search
CPC ..... G09G 5/10; G09G 2320/0626; G09G 2330/021; G09G 2358/00; G09G 2354/00; G06F 3/0482
See application file for complete search history.

(56) References Cited

U.S. PATENT DOCUMENTS 8,830,221 B2 9/2014 Yeh et al.
2008/0117367 A1* 5/2008 Abe ..... G02F 1/13452 349/106
2009/0067156 A1* 3/2009 Bonnett ..... G02F 1/133621 362/97.2
2013/0127725 A1* 5/2013 Sugimoto ..... G06F 3/02 345/168
2013/0162924 A1 6/2013 Sahouani et al.
2014/0009377 A1* 1/2014 Shibazaki ..... G09G 3/36 345/102
2014/0049527 A1* 2/2014 Lanzoni ..... G09G 3/36 345/207
2014/0184471 A1* 7/2014 Martynov ..... G06F 1/1637 345/1.2
2015/0100890 A1* 4/2015 Kosmiskas ..... G06F 8/61 715/744
2015/0363584 A1* 12/2015 Chu ..... G06F 21/31 726/28
2016/0225343 A1* 8/2016 Ek ..... H04N 13/334
2016/0266302 A1* 9/2016 Seen ..... G02B 6/0046
2017/0023725 A1* 1/2017 Oki ..... G02B 6/0038
2017/0263208 A1* 9/2017 Imai ..... G09G 3/342

* cited by examiner

*Primary Examiner* — Barry Drennan
*Assistant Examiner* — Khoa Vu
(74) *Attorney, Agent, or Firm* — Larson Newman, LLP

(57) ABSTRACT

An information handling system includes a processing device and a display. The processing device detects a privacy mode trigger, and provides a privacy mode control signal in response to detecting the privacy mode trigger. The display includes a screen to provide an image, and a backlight control module. The backlight control module controls a brightness of the image based on a display mode of the display, and provides the image in a privacy mode in response to receiving the privacy mode control signal.

19 Claims, 4 Drawing Sheets

INFORMATION HANDLING SYSTEM WITH DYNAMIC PRIVACY MODE DISPLAY

FIELD OF THE DISCLOSURE

The present disclosure generally relates to information handling systems, and more particularly relates to an information handling system with a dynamic privacy mode display.

BACKGROUND

As the value and use of information continues to increase, individuals and businesses seek additional ways to process and store information. One option is an information handling system. An information handling system generally processes, compiles, stores, or communicates information or data for business, personal, or other purposes. Technology and information handling needs and requirements can vary between different applications. Thus information handling systems can also vary regarding what information is handled, how the information is handled, how much information is processed, stored, or communicated, and how quickly and efficiently the information can be processed, stored, or communicated. The variations in information handling systems allow information handling systems to be general or configured for a specific user or specific use such as financial transaction processing, airline reservations, enterprise data storage, or global communications. In addition, information handling systems can include a variety of hardware and software resources that can be configured to process, store, and communicate information and can include one or more computer systems, graphics interface systems, data storage systems, networking systems, and mobile communication systems.

SUMMARY

An information handling system includes a processing device and a display. The processing device detects a privacy mode trigger, and provides a privacy mode control signal in response to detecting the privacy mode trigger. The display includes a screen to provide an image, and a backlight control module. The backlight control module controls a brightness of the image based on a display mode of the display, and provides the image in a privacy mode in response to receiving the privacy mode control signal.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings indicates similar or identical items.

DETAILED DESCRIPTION OF THE DRAWINGS

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

Figure 1:
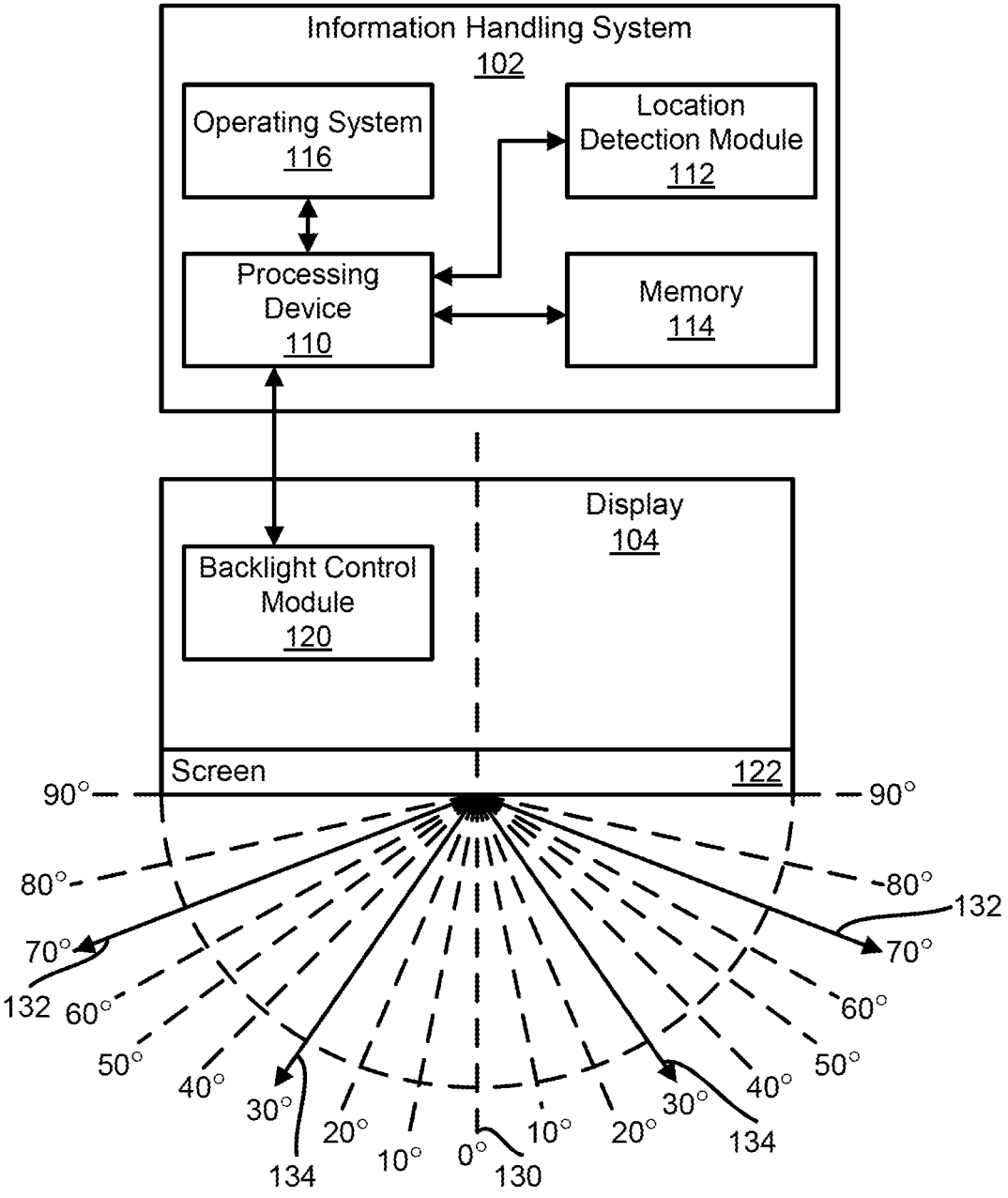
FIG. 1 is a block diagram of an information handling system including a display according to an embodiment of the present disclosure.

FIG. 1 illustrates a block diagram of information handling systems 102 and a display 104. For purposes of this disclosure, the information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer (desktop, laptop, all-in-one computer, etc.), a consumer electronic device, a network server or storage device, a switch router, wireless router, or other network communication device, a network connected device (cellular telephone, tablet device, etc.), or any other suitable device, and can vary in size, shape, performance, price, and functionality and price. The information handling system can also be implemented as or incorporated into various devices, such as a laptop computer, a tablet computer, a set-top box (STB), a mobile information handling system, a palmtop computer, a desktop computer, a communications device, a wireless telephone, a smart phone, a wearable computing device, a land-line telephone, a control system, a camera, a scanner, a facsimile machine, a printer, a pager, a personal trusted device, a web appliance, a network router, switch or bridge, or any other machine capable of executing a set of instructions (sequential or otherwise) that specify actions to be taken by that machine. In a particular embodiment, the information handling system can be implemented using electronic devices that provide voice, video or data communication. Further, while a single information handling system 102 is illustrated in FIG. 1, the term "system" shall also be taken to include any collection of systems or sub-systems that individually or jointly execute a set, or multiple sets, of instructions to perform one or more computer functions.

The information handling system 102 includes a processing device 110, a location detection module 112, a memory 114, and an operating system 116. The display 104 includes a backlight control module 120 and a screen 122. The processing device 110 is in communication with the location detection module 112, with the memory 114, with the operating system 116, and with the backlight control module 120. In an embodiment, the display 104 can be separate from the information handling system 102 as shown in FIG. 1. In another embodiment, the display 104 can be incorporated within the information handling system 102.

Figure 2:
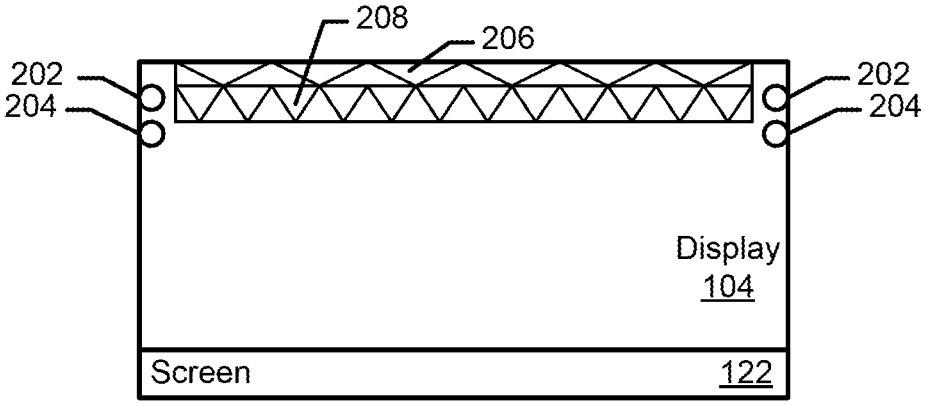
FIG. 2 is a diagram of an embodiment of the display according to an embodiment of the present disclosure.
Figure 3:
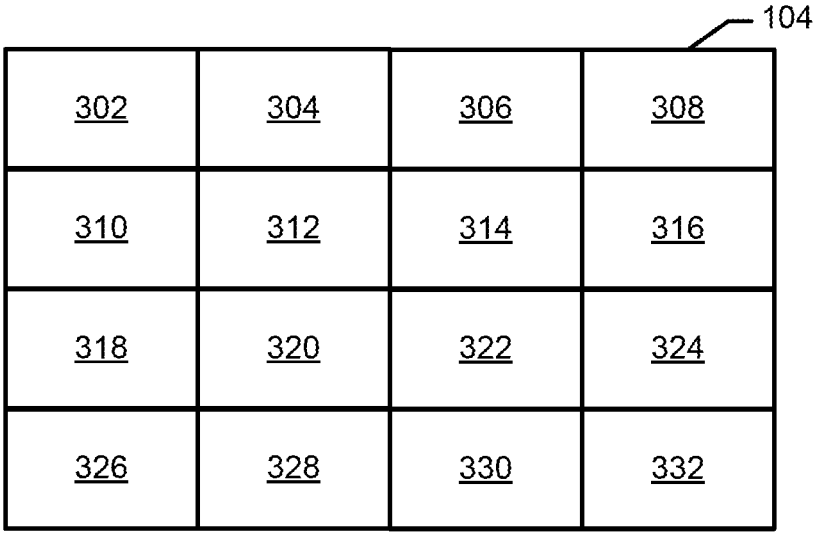
FIG. 3 is a diagram of another embodiment of the display according to an embodiment of the present disclosure.

During operation, the display 104 can provide image outputs on the screen 122, and the brightness of the image outputs can be controlled by the brightness of the backlights, shown in FIGS. 2 and 3, of the display 104. The processing device 110 can provide control signals to the backlight control module 120, which in turn can control the backlights of the display 104 to place the display in either a normal mode or a privacy mode. The normal mode and the privacy mode can each be defined by the angle out from a center reference line 130 of the display 104 that an individual can see the image on screen 122. In an embodiment, the normal mode is defined by a user being able to see the image up to a first angle, such as 70° as shown by line 134, from the reference line 130. In an embodiment, the privacy mode is defined by a user being able to see the image up to a second angle, such as 30° as shown by line 134, from the reference line 130. Thus, when the display 104 is in the privacy mode an individual has to be more directly in front of the display 104, such as at a closer angle to the reference line 130, to see the image than when the display 104 is in the normal mode. In an embodiment, a switchable lens can be used with a single backlight to change the focus of the display based on the privacy mode of the display 104. In this embodiment, the thickness of the display 104 can be greater than in the embodiments discussed below in FIGS. 2 and 3. In another embodiment, a two display or organic light emitting diode (OLED) display with liquid crystal switchable layer can be utilized to narrow the beam and therefore reduce the viewing angle in the privacy mode of the display 104.

The transition between the normal mode and the privacy mode can be triggered by different events detected by the components of the information handling system 102. For example, the privacy mode can be triggered by the location of the information handling system 102, presence tagging, calendar items, document based privacy settings, user preferences or commands, or the like. The location detection module 112 can track the location of the information handling system 102 based on global position system (GPS) coordinates, and can provide the GPS location of the information handling system 102 to the processing device 110. The processing device 110 can then compare the GPS location to locations saved in the memory 114. In an embodiment, the locations within the memory 114 can be preset locations that the individual wants the display to be in the privacy mode. Thus, if the processing device 110 determines that the location of the information handling system 102 matches a location saved in the memory 114, the processing device 110 can send a prompt to the display 104 that is to be provided on the screen 122. In an embodiment, the prompt can include "Switch to Privacy Mode" to ask the individual if he or she would like the display to switch from the normal mode to the privacy mode, and the prompt can also include selectable buttons so that the individual can select whether or not to enter the privacy mode. In response to the individual selecting to enter the privacy mode, the processing device 110 can send a control signal to the backlight control module 120 to cause the display 104 to enter in the privacy mode.

The processing device 110 can also access a digital calendar for the individual saved in the memory 114 to determine display mode of the display 104. In an embodiment, if the user does not have anything scheduled at the current time, the processing device 110 can determine that the display 104 can be in the normal mode unless another trigger indicates that the display should be in the privacy mode. However, if the calendar indicates that the individual is scheduled to be on a plane at the current time, the processing device 110 can send a control signal to the backlight control module 120 to cause the display 104 to enter into a privacy mode. However, before the display 104 is switched to the privacy mode the display mode switch prompt can be provided to the user for verification of the mode switch as discussed above.

While the individual is opening different documents, the operating system 116 can detect a document tag within the document. This document tag can indicate a privacy level for the document. For example, a financial document, a legal document, an electronic mail message, or the like can each have different privacy levels assigned. If the privacy level is above a particular threshold, the operating system 116 can indicate that the display 104 should be in the privacy mode. The processing device 110 can receive this indication from the operating system 116, and the processing device can provide the backlight control module 120 with a privacy mode control signal.

The processing device 110 can also determine that the display 104 should be in the privacy mode in response to receiving a particular key combination from the individual. When the privacy mode key combination is received, the processing device 110 can cause the backlight control module 120 to place the display 104 in the privacy mode without first displaying the display mode switch prompt to the individual. In this situation, the key combination being received from the individual can be indication enough that the individual wants the display 104 in the privacy mode without prompting the individual again. In an embodiment, a different key combination can cause the processing device 110 to send a control signal to the backlight control module 120 to place the display 104 in the normal mode.

FIG. 2 shows a diagram of the display 104 according to an embodiment of the present disclosure. In this embodiment, the display 104 includes to normal mode backlight light emitting diodes (LEDs) 202, privacy mode LEDs 204, a normal mode prism configuration 206, and a privacy mode prism configuration 208. In an embodiment, the normal mode LEDs 202 are turned to emit light on the normal mode prism configuration 206 while the display is in the normal mode. Thus, the combination of the normal mode LEDs 204 and the normal mode prism 206 can provide an amount of backlight on the screen 122 to enable an individual to see the image on the screen at angles up to 70° from the reference line 130 of FIG. 1. The privacy mode LEDs 204 are turned to emit light on the privacy mode prism configuration 208 while the display is in the privacy mode. Therefore, the combination of the privacy mode LEDs 206 and the privacy mode prism 208 can provide an amount of backlight on the screen 122 to enable an individual to see the image on the screen at angles up to 30° from the reference line 130 and prevent individuals from seeing an image on the screen 122 at angles greater than 30°.

FIG. 3 shows a diagram of the display 104 according to an embodiment of the present disclosure. In this embodiment, the display 104 includes multiple segmented backlight portions 302, 304, 306, 308, 310, 312, 314, 316, 318, 320, 322, 324, 326, 328, 330, and 332 (backlight portions 302-332). In an embodiment, the backlight control module 120, of FIG. 1, can control which of the backlight portions 302-332 are powered on depending on the display 104 being in either the normal mode or the privacy mode. If the display 104 is in the normal mode, then the backlight control module 120 can power all of the backlight portions 302-332. However, if the display 104 is in the privacy mode, then the backlight control module 120 can power only the backlight portions 312, 314, 320, and 322. This smaller area of the display 104 can reduce the ability of other individuals near the display 104 from seeing the image on the display, which in turn can increase the privacy of the display. Additionally, while the display 104 is in the privacy mode an amount of power provided to the backlight portions 302-332 is reduced based on only backlight portions 312, 314, 320, and 322 being powered. In an embodiment, the power savings can be any percentage less than the normal mode power usage, such as 10%, 20%, 25%, or the like.

Figure 4:
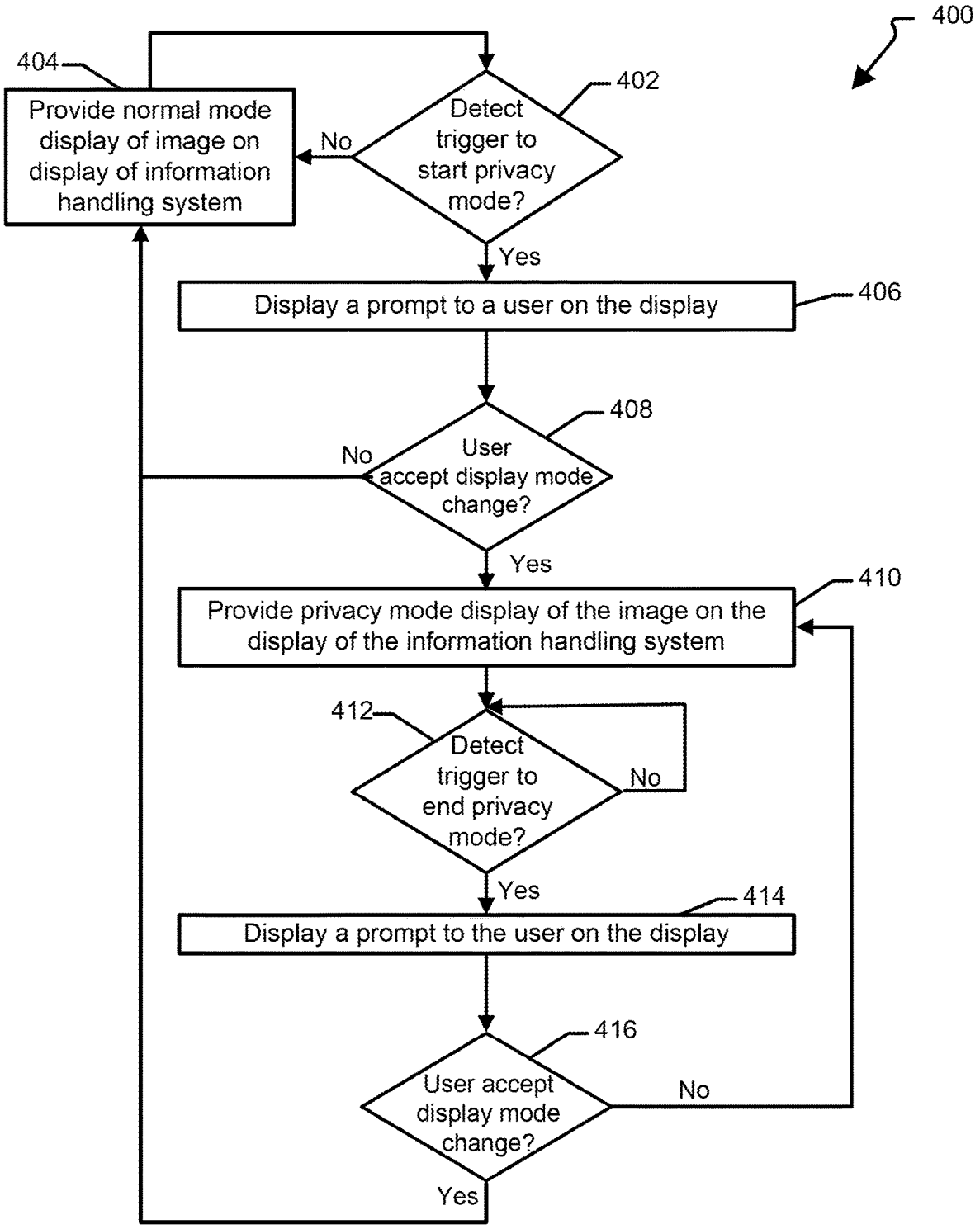
FIG. 4 is a flow diagram illustrating a method for switching a display of an information handling system between a normal mode and a privacy mode according to an embodiment of the present disclosure.

FIG. 4 shows a method 400 for switching a display of an information handling system between a normal mode and a privacy mode according to an embodiment of the present disclosure. At block 402, a determination is made whether a trigger to start a privacy mode of the display is detected. In an embodiment, the trigger can be the location of the information handling system, presence tagging, calendar items, document based privacy settings, user preference, or the like. If a trigger is not detected, a normal mode display of an image is provided on the display at block 404, and the flow continues as stated above at block 402. In an embodiment, the normal mode enables individuals to see the image provided on the display up to a first angle from a reference line in a center of the display. For example, the first angle can be 70° in either direction from the reference line.

When a trigger is detected a prompt is displayed to a user on the display at block 406. In an embodiment, the prompt can include "Switch to Privacy Mode" to ask the individual if he or she would like the display to switch to a privacy mode, and the prompt can also include selectable buttons so that the individual can select whether or not to enter the privacy mode. At block 408, a determination is made whether the user has accepted the display mode change. If the user does not accept the display mode change, the flow continues as stated above at block 404. If the user does accept the display mode change, a privacy mode display of the image is provided on the display at block 410. In an embodiment, the normal mode enables individuals to see the image provided on the display only up to a second angle from the reference line of the display. For example, the second angle can be 30° in either direction from the reference line.

At block 412, a determination is made whether a trigger to end the privacy mode has been detected. In an embodiment, the trigger to end the privacy mode can be the location of the information handling system, presence tagging, calendar items, document based privacy settings, user preference, or the like. When the trigger to end the privacy mode is detected a prompt is displayed to a user on the display at block 414. In an embodiment, the prompt can include "Switch to Normal Mode" to ask the individual if he or she would like the display to switch to a normal mode, and the prompt can also include selectable buttons so that the individual can select whether or not to enter the privacy mode. At block 416, a determination is made whether the user has accepted the display mode change. If the user does not accept the display mode change, the flow continues as stated above at block 410. If the user does accept the display mode change, the flow continues as stated above at block 404.

Figure 5:
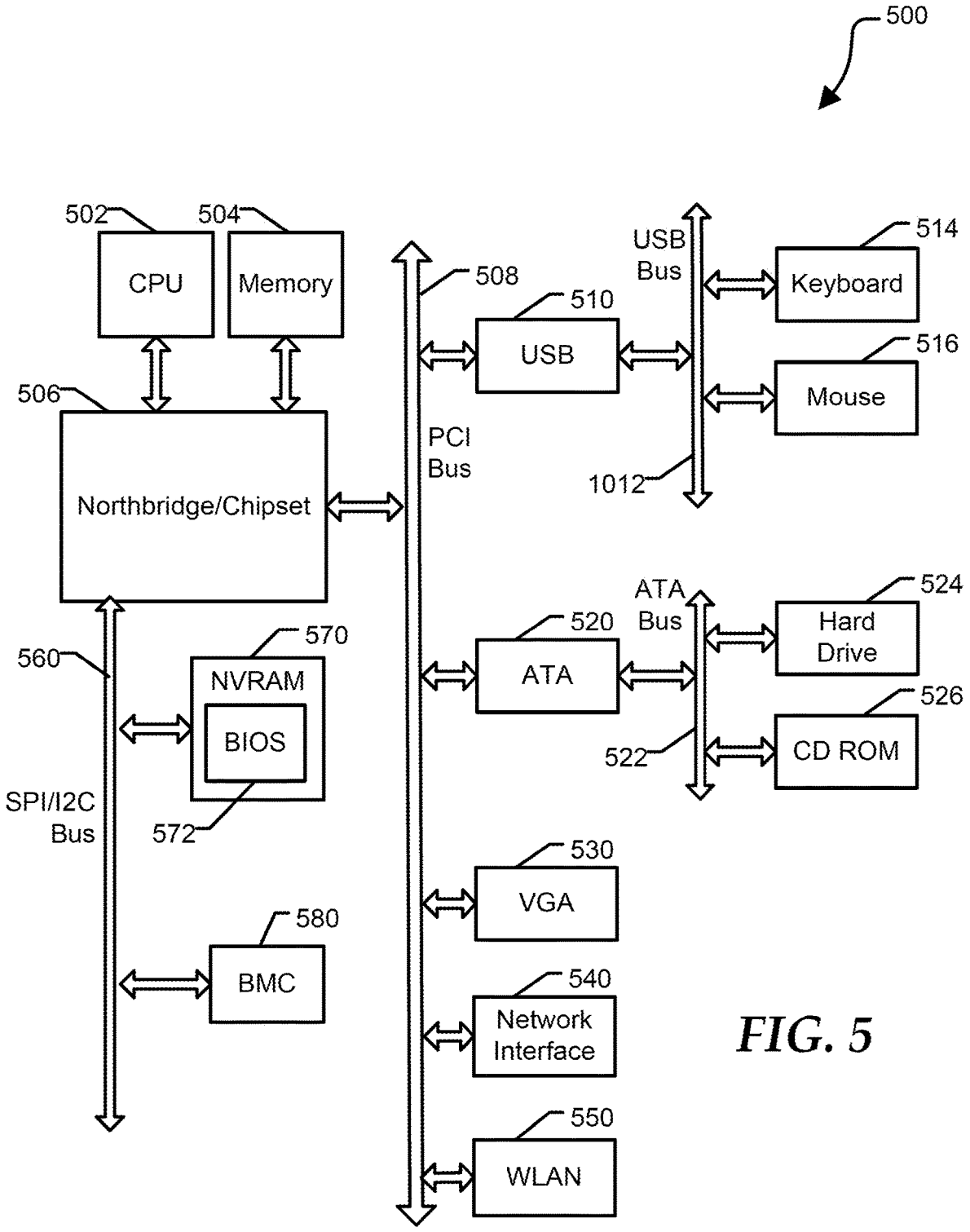
FIG. 5 is a block diagram of a general information handling system according to an embodiment of the present disclosure.

FIG. 5 shows an information handling system 500 including a processor 502, a memory 504, a northbridge/chipset 506, a PCI bus 508, a universal serial bus (USB) controller 510, a USB 512, a keyboard device controller 514, a mouse device controller 516, a configuration an ATA bus controller 520, an ATA bus 522, a hard drive device controller 524, a compact disk read only memory (CD ROM) device controller 526, a video graphics array (VGA) device controller 530, a network interface controller (NIC) 540, a wireless local area network (WLAN) controller 550, a serial peripheral interface (SPI) bus 560, a NVRAM 570 for storing BIOS 572, and a baseboard management controller (BMC) 580. BMC 580 can be referred to as a service processor or embedded controller (EC). Capabilities and functions provided by BMC 580 can vary considerably based on the type of information handling system. For example, the term baseboard management system is often used to describe an embedded processor included at a server, while an embedded controller is more likely to be found in a consumer-level device. As disclosed herein, BMC 580 represents a processing device different from CPU 502, which provides various management functions for information handling system 500. For example, an embedded controller may be responsible for power management, cooling management, and the like. An embedded controller included at a data storage system can be referred to as a storage enclosure processor.

For purpose of this disclosure information handling system 500 can include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, information handling system 500 can be a personal computer, a laptop computer, a smart phone, a tablet device or other consumer electronic device, a network server, a network storage device, a switch, a router, or another network communication device, or any other suitable device and may vary in size, shape, performance, functionality, and price. Further, information handling system 500 can include processing resources for executing machine-executable code, such as CPU 502, a programmable logic array (PLA), an embedded device such as a System-on-a-Chip (SoC), or other control logic hardware. Information handling system 500 can also include one or more computer-readable medium for storing machine-executable code, such as software or data.

Information handling system 500 can include additional processors (not shown at FIG. 1) that are configured to provide localized or specific control functions, such as a battery management controller. Bus 560 can include one or more busses, including a SPI bus, an I2C bus, a system management bus (SMBUS), a power management bus (PMBUS), and the like. BMC 580 can be configured to provide out-of-band access to devices at information handling system 500. As used herein, out-of-band access herein refers to operations performed prior to execution of BIOS 572 by processor 502 to initialize operation of system 500.

BIOS 572 can be referred to as a firmware image, and the term BIOS is herein used interchangeably with the term firmware image, or simply firmware. BIOS 572 includes instructions executable by CPU 502 to initialize and test the hardware components of system 500, and to load a boot loader or an operating system (OS) from a mass storage device. BIOS 572 additionally provides an abstraction layer for the hardware, such as a consistent way for application programs and operating systems to interact with the keyboard, display, and other input/output devices. When power is first applied to information handling system 500, the system begins a sequence of initialization procedures. During the initialization sequence, also referred to as a boot sequence, components of system 500 are configured and enabled for operation, and device drivers can be installed. Device drivers provide an interface through which other components of the system 500 can communicate with a corresponding device.

Information handling system 500 can include additional components and additional busses, not shown for clarity. For example, system 500 can include multiple processor cores, audio devices, and the like. While a particular arrangement of bus technologies and interconnections is illustrated for the purpose of example, one of skill will appreciate that the techniques disclosed herein are applicable to other system architectures. System 500 can include multiple CPUs and redundant bus controllers. One or more components can be integrated together. For example, portions of northbridge/chipset 506 can be integrated within CPU 502. Additional components of information handling system 500 can include one or more storage devices that can store machine-executable code, one or more communications ports for communicating with external devices, and various input and output (I/O) devices, such as a keyboard, a mouse, and a video display. An example of information handling system 500 includes a multi-tenant chassis system where groups of tenants (users) share a common chassis, and each of the tenants has a unique set of resources assigned to them. The resources can include blade servers of the chassis, input/output (I/O) modules, Peripheral Component Interconnect-Express (PCIe) cards, storage controllers, and the like.

Information handling system 500 can include a set of instructions that can be executed to cause the information handling system to perform any one or more of the methods or computer based functions disclosed herein. The information handling system 500 may operate as a standalone device or may be connected to other computer systems or peripheral devices, such as by a network.

In a networked deployment, the information handling system 500 may operate in the capacity of a server or as a client user computer in a server-client user network environment, or as a peer computer system in a peer-to-peer (or distributed) network environment. The information handling system 500 can also be implemented as or incorporated into various devices, such as a personal computer (PC), a tablet PC, a set-top box (STB), a personal digital assistant (PDA), a mobile device, a palmtop computer, a laptop computer, a desktop computer, a communications device, a wireless telephone, a land-line telephone, a control system, a camera, a scanner, a facsimile machine, a printer, a pager, a personal trusted device, a web appliance, a network router, switch or bridge, or any other machine capable of executing a set of instructions (sequential or otherwise) that specify actions to be taken by that machine. In a particular embodiment, the computer system 500 can be implemented using electronic devices that provide voice, video or data communication. Further, while a single information handling system 500 is illustrated, the term "system" shall also be taken to include any collection of systems or sub-systems that individually or jointly execute a set, or multiple sets, of instructions to perform one or more computer functions.

The information handling system 500 can include a disk drive unit and may include a computer-readable medium, not shown in FIG. 5, in which one or more sets of instructions, such as software, can be embedded. Further, the instructions may embody one or more of the methods or logic as described herein. In a particular embodiment, the instructions may reside completely, or at least partially, within system memory 504 or another memory included at system 500, and/or within the processor 502 during execution by the information handling system 500. The system memory 504 and the processor 502 also may include computer-readable media.

In an alternative embodiment, dedicated hardware implementations such as application specific integrated circuits, programmable logic arrays and other hardware devices can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

The present disclosure contemplates a computer-readable medium that includes instructions or receives and executes instructions responsive to a propagated signal; so that a device connected to a network can communicate voice, video or data over the network. Further, the instructions may be transmitted or received over the network via the network interface device.

While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories.

Further, the computer-readable medium can be a random access memory or other volatile re-writable memory. Additionally, the computer-readable medium can include a magneto-optical or optical medium, such as a disk or tapes or other storage device to store information received via carrier wave signals such as a signal communicated over a transmission medium. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

Although only a few exemplary embodiments have been described in detail above, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed is:

1. A method comprising:

providing an image on a screen of a display of an information handling system, wherein brightness of the image is controlled by backlights of the display, wherein the backlights of the display include normal mode backlight light emitting diodes and privacy mode backlight light emitting diodes, and wherein the normal mode backlight light emitting diodes are distinct from the privacy mode backlight light emitting diodes and both are located on each side of the display;

emitting light, by the normal mode backlight light emitting diodes located on both sides of a normal mode prism configuration within the display, on the normal mode prism configuration while the display is in a normal mode;

detecting, by a processing device of the information handling system a first trigger based on a first triggering event of a plurality of triggering events, wherein the first trigger is a normal mode trigger associated with the display;

providing the image in the normal mode of the display in response to the normal mode trigger being detected unless detecting a second trigger based on a second triggering event of the triggering events, wherein the second trigger is a privacy mode trigger associated with the display;

detecting, by the processing device of the information handling system, the privacy mode trigger based on the second triggering event that is above a threshold;

determining whether to provide a prompt to a user to determine whether the user accepts a display mode change;

providing the image in a privacy mode of the display in response to the privacy mode trigger being detected and in response to the determining not to provide the prompt to the user; and emitting light, by the privacy mode backlight light emitting diodes located on both sides of a privacy mode prism configuration within the display, on the privacy mode prism configuration while the display is in the privacy mode, wherein the privacy mode backlight light emitting diodes use switchable lenses to change a focus of the display.

2. The method of claim 1, further comprising:

in response to the determining to provide the prompt to the user, providing the prompt to the user to determine whether the user accepts the display mode change prior to providing the image in the privacy mode; and receiving a display mode change verification prior to providing the image in the privacy mode.

3. The method of claim 1, wherein a viewable angle of the image in the privacy mode is from a reference line of the display to a first angle measured from the reference line, and the viewable angle of the image in the normal mode is from the reference line to a second angle measured from the reference line.

4. The method of claim 3, wherein the second angle is greater than the first angle.

5. The method of claim 1, wherein the normal mode trigger is selected from a list including a location of the information handling system, presence tag settings, calendar items, document based privacy settings, and user commands.

6. The method of claim 1, wherein the privacy mode trigger is selected from a list including a location of the information handling system, presence tag settings, calendar items, and user commands.

7. A method comprising:

emitting light on both sides of a normal mode prism configuration within a display, by normal mode backlight light emitting diodes located on both sides of the normal mode prism configuration, on the normal mode prism configuration while the display is in a normal mode, wherein first prism angles in the normal mode prism configuration are distinct from second prism angles in a privacy mode prism configuration;

determining, by a processing device of an information handling system, whether a first trigger based on a first triggering event of a plurality of triggering events is detected, wherein the first trigger is a normal mode trigger associated with the display;

providing an image in the normal mode of the display in response to the first trigger being detected unless second trigger based on a second triggering event of a plurality of triggering events is detected, wherein the second trigger is a privacy mode trigger associated with the display;

determining, by the processing device of the information handling system, whether the privacy mode trigger associated with the display is detected, wherein the privacy mode trigger is detected based on the second triggering event, wherein the second triggering event is based on a plurality of pre-defined locations stored in a memory, wherein one of the pre-defined locations matches a location of the information handling system;

determining whether to provide a prompt to a user to determine whether the user accepts a display mode change;

switching a display mode of the image on a screen of the display between the normal mode and a privacy mode in response to the privacy mode trigger being detected and in response to the determining not to provide the prompt to the user; and emitting light on both sides of the privacy mode prism configuration within the display, by privacy mode backlight light emitting diodes located on both sides of the privacy mode prism configuration, on the privacy mode prism configuration while the display is in the privacy mode, wherein the privacy mode backlight emitting diodes are distinct from the normal mode backlight light emitting diodes and both are located on each side of the display.

8. The method of claim 7, further comprising:

in response to the determining to provide the prompt to the user, providing the prompt to the user to determine whether the user accepts the display mode change prior to switching to the privacy mode; and receiving a display mode change verification prior to switching to the privacy mode.

9. The method of claim 7, wherein switching to the privacy mode comprises:

reducing a number of backlight portions powered on in the display, wherein reducing the number of backlight portions reduces a size of the image on the screen.

10. The method of claim 9, wherein reducing the number of backlight portions powered on creates a power savings in the display during the privacy mode.

11. The method of claim 7, wherein a viewable angle of the image in the privacy mode is from a reference line of the display to a first angle measured from the reference line, and the viewable angle of the image in the normal mode is from the reference line to a second angle measured from the reference line.

12. The method of claim 11, wherein the second angle is greater than the first angle.

13. The method of claim 7, wherein the privacy mode trigger includes calendar items, document based privacy settings, and user commands.

14. An information handling system comprising:

a processing device to detect a privacy mode trigger, to determine whether to provide a prompt to a user to determine whether the user accepts a display mode change, and to provide a privacy mode control signal in response to detecting the privacy mode trigger and in response to determining not to provide the prompt to the user; and a display including:

a screen to provide an image;

a normal mode prism configuration located behind a privacy mode prism configuration within the display, wherein the normal mode prism configuration is distinct from the privacy mode prism configuration;

the privacy mode prism configuration located closer to the screen than the normal mode prism configuration within the display;

a normal mode backlight light emitting diode located on both sides of the normal and privacy mode prism configurations within the display, the normal mode backlight light emitting diode to emit light on the normal mode prism configuration from both sides of the display while the display is in a normal mode to enable an individual to see the image on the screen to a first angle measured from a reference line;

a privacy mode backlight light emitting diode located on both sides of the normal and privacy mode prism configurations within the display, the privacy mode backlight light emitting diode to emit light on the privacy mode prism configuration from both sides of the display while the display is in a privacy mode, wherein the privacy mode backlight emitting diodes are distinct from the normal mode backlight light emitting diodes and both are located on each side of the display; and a backlight control module in communication with the processing device, the backlight control module to control a brightness of the image based on a display mode of the display, and to provide the image in the privacy mode in response to receiving the privacy mode control signal to enable the individual to see the image on the screen to a second angle measured from the reference line.

15. The information handling system of claim 14, the screen to provide the prompt to the user to determine whether the user accepts the display mode change prior to the image being provided in the privacy mode, and the processing device to receive a display mode change verification prior to the image being provided in the privacy mode in response to the determining to provide the prompt to the user.

16. The information handling system of claim 14, the processing device to detect a normal mode trigger associated with the display, and the backlight control module to provide the image in the normal mode in response to the privacy mode trigger being detected.

17. The information handling system of claim 14, wherein the display further includes a plurality of backlight portions, the backlight control module to power on all of the backlight portions when the display is in the normal mode, and the backlight control module to power on less than all of the backlight portions when the display is in the privacy mode.

18. The information handling system of claim 17, wherein the display uses less power while in the privacy mode than in the normal mode based on less than all of the backlight portions in the display being powered on in the privacy mode.

19. The information handling system of claim 14, wherein the privacy mode trigger is selected from a list including a location of the information handling system, calendar items, document based privacy settings, and user commands.

* * * * *